United States Patent [19]

Bevan

[11] Patent Number: 4,522,772

[45] Date of Patent: Jun. 11, 1985

[54] MOULDING OF ARTICLES

[75] Inventor: Christopher G. Bevan, London, England

[73] Assignee: C. G. Bevan Associates Limited, London, England

[21] Appl. No.: 302,472

[22] PCT Filed: Jan. 5, 1981

[86] PCT No.: PCT/GB81/00002

§ 371 Date: Sep. 4, 1981

§ 102(e) Date: Sep. 4, 1981

[87] PCT Pub. No.: WO81/01979

PCT Pub. Date: Jul. 23, 1981

[30] Foreign Application Priority Data

Jan. 7, 1980 [GB] United Kingdom ..... 8000421

[51] Int. Cl.[3] ..... B28B 1/26

[52] U.S. Cl. ..... 264/71; 264/123; 264/333

[58] Field of Search ..... 264/71, 333, 82, 123

[56] References Cited

U.S. PATENT DOCUMENTS

| | | | |
|---|---|---|---|
| 1,427,103 | 8/1922 | Haenicke | 264/123 |
| 2,944,291 | 7/1960 | Prior et al. | 264/82 |
| 3,914,359 | 10/1975 | Bevan | 264/82 |
| 3,927,163 | 12/1975 | Gabriel et al. | 264/71 |
| 3,959,422 | 5/1976 | Wilhelm | 264/71 |
| 4,239,716 | 12/1980 | Ishida et al. | 264/86 |

FOREIGN PATENT DOCUMENTS

| | | |
|---|---|---|
| 27147 | of 1911 | United Kingdom . |
| 153491 | 11/1920 | United Kingdom . |
| 363873 | 12/1931 | United Kingdom . |
| 500926 | 2/1939 | United Kingdom . |
| 528657 | 11/1940 | United Kingdom . |
| 1067671 | 5/1967 | United Kingdom . |
| 1417001 | 12/1975 | United Kingdom . |

*Primary Examiner*—John A. Parrish

*Attorney, Agent, or Firm*—Fisher, Christen & Sabol

[57] ABSTRACT

Construction products are moulded by mixing the dry constituents, including a proportion of fine particulate material, feeding (1, 2) the mixture into a mould (5), compacting the mixture, removing part (6) of the mould (5), lightly spraying (9) an exposed upstanding surface of the product with setting liquid, removing the product from the mould (5) and allowing it to set. Sufficient fine particulate material to surround the coarse particles and compaction, using vibration (7) of the mould (5) and compression of the mixture, to cause the fine particles to fill the interstices between the coarse particles, provide sufficient support of the exposed surface to prevent collapse or erosion thereof during wetting even though no fibre reinforcement is included in the mixture. Sufficient liquid to wet the product but not to saturate it is applied by the spray (8, 9).

13 Claims, 4 Drawing Figures

FIG. 1
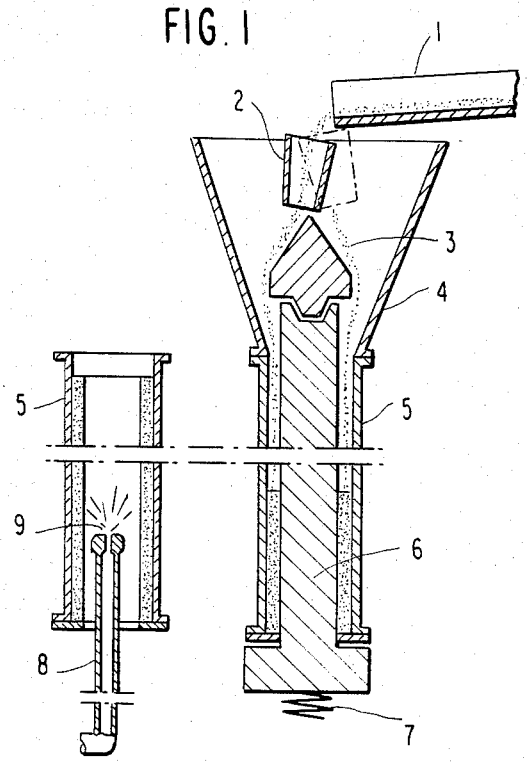
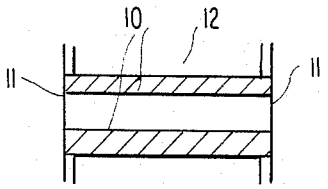
FIG. 2
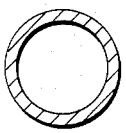
FIG. 3
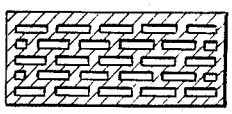
FIG. 4

MOULDING OF ARTICLES

TECHNICAL FIELD OF THE INVENTION

This invention relates to the moulding of articles and in particular to the moulding of construction products, such as partition panels, roof decking and pipes, from liquid setting particulate materials.

STATE OF THE ART

It has been customary hitherto to mould such articles as aforesaid by mixing the constituent materials, applying a sufficient quantity of setting liquid to the mix, introducing the moistened mix to the mould and allowing the mix to set before removal of the set article from the mould. This process is time-consuming and for quantity production of such articles, since the setting of the article occurs in the mould, a large number of moulds is required.

It has been proposed for example in British Pat. Nos. 528,657, 1,067,671, 1,346,767, 1,417,001 and 1,466,663 that a dry mixture of constituent materials be introduced into the mould and compacted therein. The mould is then immersed in a setting liquid or the liquid is allowed to permeate the mix by capillary action. Of these Patents, only in the case of 1,346,767 is the liquid applied to a vertical surface which is unsupported by a part of the mould apparatus, and in that case the mould is immersed in the water so that the buoyancy effect thus created offsets the tendency of such unsupported walls to collapse due to the increase in weight of the mix.

It has also been proposed in U.S. Pat. No. 1,427,103 that for producing very small moulded articles, for example buttons, the dry constituent materials be pressed into the mould, removed therefrom and then sprayed with setting liquid. However, this process is restricted to use for the production of very small articles and has not been used for the production of relatively very large articles, such as construction products, since such articles would be expected to collapse under their own weight on demoulding and may also shrink and crack during the spraying operation. In consequence it has been considered that if there is to be any vertical surface of mix which is unsupported by a part of the mould apparatus during the wetting process by seepage rather than by total immersion then it is essential to incorporate into the mixture of constituent materials some reinforcing means from which the moulded article can derive support during the spraying and setting stages of the process. The reinforcing means may be fibres, and examples of processes incorporating the use of such fibrous reinforcing material for the supporting of the moulded article whilst unsupported at least in part by the mould are described in German Patent No. 1,683,829, British Pat. No. 1,346,767 and commonly assigned co-pending U.S. application No. 212,707, filed on Nov. 5, 1980.

DISCLOSURE OF THE INVENTION

The invention provides a method for producing moulded construction products from a liquid setting mixture of fine and coarse particulate materials comprising the steps of mixing the dry constituenet materials, said materials including a proportion of fine particles sufficient to substantially surround all coarse particles but not including fibrous reinforcing materials, introducing said mixture into a mould, compacting said mixture in said mould to an extent that said fine particles substantially fill the interstices between said coarse particles, removing at least a part of the mould from contact with the thus moulded product, spraying the product at a surface unsupported by said mould with a predetermined quantity of a setting liquid, being a quantity sufficient to wet all of the compacted constituents but insufficient completely to saturate the same, and allowing said product to set.

Surprisingly, it has now been found that provided that there is sufficient compaction and a sufficient proportion of fine particles in the mixture of constituents no fibres or other reinforcement are required and a satisfactory moulded article may be obtained which, without collapse, can be demoulded before the onset of chemical curing and which does not shrink or crack during the spraying and setting process. Because of this the method of the invention can be used for the manufacture of high quality precast concrete products having no fibrous reinforcing therein, and in respect of which removal of the article from the mould after compaction and prior to spraying can be used to economic advantage by reducing the number of moulds needed for quantity production of such articles.

In addition to immediate demoulding, concrete products produced by the new method have an unusually high quality finish, high immediate demoulding strength and can be moulded to intricate shapes, without the application of high pressure or heavy ramming or tamping. This combination of features is unique in concrete making.

In conventional concrete practice, immediate demoulding can be achieved by vibrating or ramming so-called "earth damp" mixes into moulds but the products are generally characterized by a granular surface finish as in "breeze" blocks. At present, smooth finishes for immediately demoulding products can only be obtained by using extremely high compacting forces, such as the centrifugal forces, used in the "Packer-head" process for pipe manufacture. Such processes, however, are only suitable for simple shapes, compared to the intricate section, which can be produced by the new method. Alternatively, relatively smooth finishes can be obtained by conventional wet casting but here the wet concrete sticks to the moulds and can only be removed once the material has set. Furthermore, although these surfaces tend to be smoother than those made from "earth damp" mixes, they are characterised by "pin holes" and other blemishes, arising from bubbles within the liquid which do not occur with the new method.

Another departure from the core spray method of commonly-assigned co-pending U.S. application No. 212,707 is the discovery that with adequate compaction and suitable powder formulation, it is possible for completely dry mixes to stand intact with one or more of the mould sides removed. If rigid steel bar or mesh reinforcement is incorporated, it is sometimes possible to remove all the sides of the mould (other than the base) without collapse of the dry compacted mix. This means that, whereas previously access for spraying could only be via internal core holes, it is now possible to spray onto free-standing external vertical surfaces. This widens the range of shapes which can be handled. Also, water penetration can be speeded (particularly for thick sections) by, for example stabilizing the core zones by an initial internal spray and then removing both main sides of the mould for further spraying via the outer surface.

These developments are surprising when viewed in relation to normal preconceptions in the industry or in relation to the published prior art. So far, it has been considered essential that some form of support be provided to the dry vertical surfaces to prevent collapse either prior to or during the application of liquid, typical means of support being either some form of external support (such as perforated plates or membranes) or more recently internal fibres. It have now found that if the correct procedures are followed, no support of the dry surfaces being sprayed is needed at all. (Such support as may be required for the mass as a whole can be provided at the surfaces which do not need to be sprayed as described later). Furthermore, it was previously thought that at least some fibres were needed to prevent erosion of the free-standing material in, for example, the core holes, and it has been found that with sufficient compaction and fines content and a sufficiently fine spray, remarkably smooth bores can be obtained with no fibrous support.

The invention method is an improvement, in one sense of the method described in British Pat. No. 1,346,767 in which after the withdrawal of the bore former(s) the mix is saturated by total immersion in water and only removed from the mold after significent setting has taken place—i.e., sufficient water is provided to completely fill the interstices between particles and substantially complete the chemical reaction. The tendency to subside before setting is restrained by the buoyancy effect from the immersion and by the water in the bore(s) supporting the water in the interstices of the powder.

In British Patents Nos. 1,067,671 and 363,873 there is described a process in which construction products are manufactured by the application of just sufficient water to a dry mix to cause setting of the mix, i.e., to wet, but not to saturate the same. The mold is immersed in water or water is injected under pressure, but the water is allowed access to the mix only through perforations in the walls of the mold and seepage by capillary action enables the water to reach the whole of the mix. During these wetting processes the vertical surface of the molded mix are supported by the mold walls.

Surprisingly it has been found that by means of the present invention water may be introduced into a dry mix through unsupported vertical surfaces without either collapse or erosion of those surfaces. In the new method, after withdrawing the bore former(s) only just sufficient liquid is applied to substantially the whole of the unsupported vertical surface(s) of the bore(s) to wet, but not saturate as in the U.S. Pat. No. 1,346,767 method, the powder/fiber mix by, for example, lightly spraying the powder surfaces of the bore(s).

Another very surprising feature is the unexpectedly high strength of the dampened, compacted material immediately after demoulding. In slow setting Portland cement-based formulations, this so-called "green" strength occurs well before any strength can develop from the chemical reaction with the water. Hence the unusual stiffness and cohesiveness of the moulding at this stage can only be due to physical properties, such as mechanical particle interlock and surface tension effects.

It is possible for example to demould some products made by the new method by hand, without requiring vacuum lifting or other special equipment designed to minimise demoulding stresses.

In common with fibrous panels made by the aforementioned core spray method, it is worth noting the lack of any adhesion to the mould sides after spraying, despite the very strong adhesion between the particles themselves. Provided the amount of water sprayed is such as not to saturate the mass, mould sides come away remarkably cleanly and sufficiently dry to be ready for the next filling.

Broadly, the range of products and manufacturing sequence for the present method follows the method of fibrous core spraying, except that fibres are omitted and spraying can be other than via the core holes. Spraying is largely on vertical (or approximately vertical) surfaces, which generally comprise at least half of the total vertical surfaces of the products. In the case of spraying via the cores in panel products, the spray area is significantly more than half the total vertical area. Sprayed surfaces can be ribbed or textured, particularly in the case of exterior sprayed surfaces, where the moulds do not have to be withdrawn by sliding parallel to the surface, as is usually the case with core hole surfaces. Generally, in the case of rectangular products, the dry compacted material needs at least two mould sides to remain in place during spraying, so the dry material can support itself by arch action between the remaining two mould surfaces. In the case of annular shapes, generally at least the outer or inner mould surface should remain in place during spraying to provide support to the dry compacted mass.

The remaining distinctions between the present method and the method of commonly-assigned U.S. application No. 212,707 largely relate to the degree of dry compaction applied and the provision of adequate fines in the mix.

For example, in the science of soil mechanics, particles are broadly categorised as clays, silts, or sands. The particle sizes of clays are extremely cohesive when in a damp, compressed state. Sands, on the other hand, are not cohesive under any circumstances and silts occupy an intermediate position. It is not necessary with the present process to do down to clay-like particle sizes and the process will not work solely with sands (unless the sand is combined with finer material).

Common commercially available liquid setting powders such as Portland cement or gypsum would probably be classified (in terms of particle size) as silts. It has been found that such powders work well with the present process. Finer powders would give more stable mouldings, but these are more difficult to compact properly (unless the mix contains a proportion of coarse particles or compacting means other than vibration alone are used). Broadly, it has been found that to achieve adequate compaction, powder feed rates have to be slower, e.g. up to half the speed that has been used heretofore. If filling rates are too fast (and/or vibration insufficient), some of the interstices may not be completely filled before subsequent layers of material compact into an effective bridge above. If this happens no further downward percolation is generally possible and the voids remain only partly filled, even is subjected to prolonged or even increased vibration.

Optimum filling rates depend very much on mix proportions, particle size, etc. Generally for mixes with near to the optimum economic proportions of coarse aggregate, filling rates are generally slow—i.e. less 10 mm per sec. Compacting vibration must be more intense and of a higher frequency than has been usual heretofore e.g. preferably at least 12,000 cycles per minute. The more effective the compaction, the less critical is the quantity of fines present, provided at least sufficient fines are present to surround the coarse particles. Mixes need to be as dry as possible to obtain optimum compaction as even a small degree of dampness can inhibit full compaction.

"Coarse" in this context means everything above the "slit" fraction discussed earlier i.e. it includes the proportion of sand which is generally added to concrete mixes. The ideal mix is one in which the cement (for example) compacts into all the interstices between the sand and the sand/cement mix in turn compacts into all the interstices between the coarse aggregate.

From the processing point of view, there appears to be no particular upper limit to the size of coarse aggregate, provided that they fit readily into the mould and are completely surrounded by compacted sand/cement. Provided the aggregate component in the mix is not too coarse, in some cases the proportion of cement powder in the mix needed to generate adequate final cured strength provides all the fines needed for dry stability during manufacture. Where this is not sufficient, additional fines are added, usually in the form of pulverised fuel ash or some other suitable cheap extender. Aggregates usually consist of a range of larger particle sizes and include sand and light-weight aggregates such as those manufactured from expanded clay or sintered pulverised fuel ash. For small sectioned products, such as sewage pipes or hollow concrete blocks, the maximum aggregate size is generally around 5 mm.

Although readily processible by the present method thin sectioned, large area panels are generally not suitable as fibre reinforcement is usually required in the end product for structural reasons. However, the present method can be used for making products containing non-fibrous reinforcement, for example, such rigid reinforcement steel rods or bars as used in conventional reinforced concrete.

BRIEF DESCRIPTION OF THE DRAWINGS

FIG. 1 is a diagrammatic elevation of one form of apparatus suitable for use in practising the invention;

FIG. 2 is a plan view of the apparatus of FIG. 1 with the core removed; and FIGS. 3 and 4 are cross-sectional elevations of typical construction products manufactured in accordance with the present invention.

BEST MODE OF CARRYING OUT THE INVENTION

One of the simplest types of equipment using the new method is shown in FIG. 1. A vibrating tray 1 distributes the dry powder mix into a laterally oscillating chute 2 so that two equal streams of material pass either side of a bore former support 3 and are guided by a hopper 4 into a mould 5, containing at least one bore former 6 which is fitted at its base with a vibrator 7. While filling the mould, the bore former 6 and/or the hppper and bore former support, are vibrated to settle and thoroughly compact the mixture. After filling the mould, the upper parts of the mixture which are not compacted by a head of material above them, may be further consolidated by pressing the bore former support 3 (preferably together with the bore former 6) onto the powder mix surface until the whole mass is uniformly compacted. Vibration then ceases and the bore former 6 and bore former support are withdrawn from the mould, which then moves laterally to locate over one or more spray tubes 8. Each tube 8 is fitted at its end with a fine spray nozzle 9, which is oscillated vertically in a bore until sufficient liquid has been delivered to the bore surface(s) to just wet the mixture throughout.

The spray needs to be fine and of modest velocity to avoid surface pitting and should generally deliver liquid at an average rate which does not exceed the rate at which the liquid can be absorbed into the powder by capillary action. This prevents the surface from becoming saturated and causing drip marks or local collapse. Spraying is usually terminated before full wetting occurs, so that wetting of the still dry thicker parts of the moulding is completed by capillary action, drawing liquid from the adjacent wet parts. This allows the minimum capacity of liquid to be applied for full wetting, thus avoiding the risk of over-wetting which can cause the mixture to stick to the mould sides and reduce demoulding strengths. When the damp areas have spread throughout the mass, the mould is opened and the uncured product is removed therefrom (by vacuum lifting methods, for example) and allowed to cure.

FIG. 2 illustrates the method described above as applied to the manufacture of paving flags or the like, two such flags 10 being formed simultaneously in mould 12. The process is described in greater detail in Example 1 below.

FIGS. 3 and 4 illustrate other construction products which may be manufactured by the present process as described in Examples 2 and 3 below.

EXAMPLE 1

Simple paving flags and the like can be produced, without core holes, as shown in FIG. 2. In this case the "core former" 6 in FIG. 1 is two complete mould sides, which on withdrawal, expose the compacted particulate material for spraying (items 10 in FIG. 2). The dry material is held up by arch action between mould sides 11. Sides 12 restrain buckling in one direction but not the other, so they can also be removed before spraying. This allows both faces of material 10 to be sprayed, which is an advantage with relatively thick products like paving flags (typically measuring 50 mm thick × 600 mm × 600 mm.).

It the material is correctly formulated and compacted, it can freely span the 600 mm without any support other than at the base and at the sides 11. Product thickness for this span can be as little as 15 mm, which is surprisingly slender bearing in mind there is no binding material at all between the particles.

To be competitive, paving flags require a high coarse aggregate function of sufficient size to minimise the surface area and hence the amount of relatively expensive cement needed to bind the aggregate together. A typical mix which gives a satisfactory product strength for this application and can be processed satisfactorily consists of 1:0.3:1.2:4 parts by weight of ordinary Portland cement, pulverised fuel ash (as commonly used for concrete manufacture) standard fine grade "sharp" concreting sand and granite aggregate chippings passing a 12 mm mesh and retained on a 6 mm mesh.

The dry mixture is poured evenly into the vibrating mould, so that the level rises at approximately 500 mm per minute, while vibration frequency is maintained at 12,000 cycles per minute. Amplitude is adjusted so that the coarse aggregate on the surface is just mobile but the layers below are locked into position with the fines flowing and compacting around them. After filling, the top layer can be compacted by plunger 3 FIG. 1 but generally with the specified mix this is not very effective (due to the almost point-to-point contact of the coarse aggregate preventing movement). On removal of the core former/mould sides 6, the free surfaces are lightly sprayed until the material is just dampened throughout and the mouldings then removed by vacuum lifter to the curing zone.

EXAMPLE 2

Pulverised fuel ash (PFA) is a silicious waste material from coal fired power stations and is one of the cheapest fillers available. If the mix is autoclaved after dampening, the silica reacts with the free lime in the cement, resulting in a strong chemical bond between filler and binder. In these respects therefore it is advantageous to increase the PFA content and adjust the production procedures and mix proportions to overcome the fine powder compacting problems mentioned in Example 1.

With high PFA concentrations it has been found almost impossible to achieve the required compaction by vibration alone and a preferred method is to rely largely on direct externally applied pressure. For compression compaction to be effective, the proportion of coarse aggregate in any case has to be limited, as point-to-point contact of the latter tends to cause a series of "bridges" which shield the loose powder in the interstices from externally applied pressure. It is also preferable to limit the size of coarse aggregate to sand rather than gravel, as the former is generally easier to compact by direct pressure.

A typical application for such mixes is the manufacture of sewerage and drainage pipes of approximately 100 mm internal diameter and 15 to 20 mm wall thickness and a suitable mix would be 1:1:3 of ordinary Portland cement, PFA and sand. This is poured fairly rapidly into a moulding plant similar to that shown in FIG. 1 except that core former 6 is vibrating rather than the mould. On filling, core former 6, together with top plunger 3, move downwards to compress the powder/-sand mix, while still vibrating. After full compaction vibration ceases, core former 6 is completely withdrawn downwards and plunger 3 withdrawn upwards, before the mould moves to the spray station.

In this method, filling and top compression rates are not critical, provided there is provision for the escape of air (e.g. between the mould side and top plunger 3). Vibration is also not critical, provided it is sufficient to disrupt dry resistance to compaction by arch action in the material immediately below the top plunger 3. With the apparatus shown in FIG. 1, the core former acts as a poker vibrator, dislodging any potential arching, so that the top pressure can be fully effective throughout the product. Also, core former 6 is one of the abutments against which the material arches, so moving the core former relative to the mould side 5 (forming the other abutment) also has a powerful arch breaking effect during compaction.

EXAMPLE 3

Insulating lightweight aggregate concrete blocks can be manufactured by the new method, particularly multi-slotted, thin-walled sections as shown in FIG. 4. Although it has been known that such sections have considerably greater thermal insulation than conventional concrete blocks, the wet manufacturing methods for the latter are not suitable for such extreme shapes. By using dry methods and a specifically designed spray system, it is possible to reduce slot dimensions to 10 mm and leaf thicknesses to under 5 mm (using 4 mm max aggregate size). This is a surprisingly delicate structure, considering that prior to spraying there is no adhesion between the particles.

Manufacturing conditions and mix properties for this product are intermediate between Examples 1 to 2. A typical mix is 1:0.5:3 parts by weight of cement, PFA and "Lytag" lightweight aggregate from 4 mm down to dust. The latter is made from sintered pulverised fuel ash and is about half the density of the aggregates in the previous Examples. This aggregate also contains fines, so the mix properties are therefore not directly comparable to those in earlier Examples.

The process described in commonly-assigned U.S. application No. 212,707 relies on the fibres contained in the constituent mix acting as tensile reinforcement, preventing the dry compacted particles from cracking—or, if cracks do form, by preventing these from spreading to complete rupture. This is achieved by fibres penetrating across a crack or potential crack and holding the sections or clumps of compacted material together. Fibre pull-out is prevented by the frictional resistance of the particles bearing on the length of fibre embedded on either side of the crack.

In addition to these effects, the interlocking network of fibres acts as a barrier or screen, resisting the flow of particles between them. With such small apertures between fibre barriers, relatively modest compaction enables the particles to arch between the fibre restraints and so prevent flow. Even modest amounts of fibre have very marked affects on both dry and wet stability. For example, the green strength of the formulations in Examples 2 and 3 can be more than doubled by adding under 1% of 100 mm glass fibre strands to the constituent mix.

In the process of the present invention there are no such arch restraints, screen effects or tensile reinforcement to stabilise the material. The dry particulate mass has to be rendered stable enough for subsequent processing by the frictional resistance between particles and some slight mechanical interlocking with angular particles. This is why the fines content and compaction requirements are so much more critical with this method than with the aforementioned mixes containing fibre reinforcement. In the present process, the fine particles promote interlocking by packing into all available spaces, while the applied vibration and/or pressure ensures that the particles penetrate between the coarse aggregate and pack firm enough to generate the required frictional resistance.

The tensile strength generated by such frictional effects is generally too small for the dry material to stand entirely on its own and the structure stands by arching between at least one pair of opposite mould sides (or by ring compression, in the case of annular structures like pipes). If suitable non-fibre reinforcement is included in the product, it is possible to remove all vertical support provided by the mould.

Stability of the mix is much enhanced by capillary cohesion effects, when only just enough liquid is added. In consequence local overwetting during liquid application should be avoided, since this can cause collapse of the upstanding surfaces. However, by means of the process of the present invention, i.e. providing sufficient fines are present in the mix which is then adequately compacted, the mix can possess adequate dry and wet stability and a high enough green strength to enable the mould to be removed completely after wetting and before curing.

I claim:

1. A method of producing molded construction products from a liquid-setting mixture of fine and coarse particulate materials comprising the steps of mixing the dry constituent materials, said materials including a proportion of fine particles sufficient to substantially surround all of the coarse particles but not including fibrous reinforcing materials, introducing said mixture into a mold, vibrating at least a part of said mold to effect compaction of said mixture in said mold to an extent that said fine particles substantially fill the interstices between said coarse particles and that any vertical surface of said product will stand and be self-sustaining upon being exposed without mold support, removing at least a part of the mold from contact with the thus compacted product, thereby exposing at least one vertical surface of the compacted product, spraying the product at a surface unsupported by said mold with a predetermined quantity of a setting liquid, said quantity being sufficient to wet all of the compacted constituents so as to initiate a chemical setting reaction but insufficient to completely saturate the compacted product and to cause the associated effect of structural collapse of the compacted product in the region of said exposed surface, and allowing said product to set.

2. A method according to claim 1 comprising removing the wetting product from the mold before the onset of chemical curing.

3. A method according to claim 1 wherein said part of the mold removed before spraying comprises an inner part or former of the mold.

4. A method according to claim 1 wherein said part of the mold removed before spraying comprises an outer wall part.

5. A method according to claim 1 comprising spraying an exposed upstanding surface of said product.

6. A method according to claim 1 comprising vibrating at least a part of the mold to compact the dry constituent materials.

7. A method according to claim 1 comprising applying pressure to an upper surface of said product to compact said dry constituent materials.

8. A method according to claim 6 wherein the frequency of said vibration is at least 12,000 cycles per minute.

9. A method according to claim 1 comprising introducing said mixture into said mold at a feed rate not greater than 10 mm per second.

10. A method according to claim 9 comprising oscillating the feed of said mixture into said mold to distribute said mixture in said mold.

11. A method according to claim 1 comprising moving a spray nozzle relative to and adjacent an exposed surface of said compacted product to wet the same.

12. A method according to claim 1 wherein the proportion of fine particles in said mixture is in the range of 15 percent to 22 percent by weight.

13. The construction product manufactured by the method of claim 1.

* * * * *